US011769461B2

(12) United States Patent
Wang et al.

(10) Patent No.: US 11,769,461 B2
(45) Date of Patent: Sep. 26, 2023

(54) BACKLIGHT CONTROL METHOD AND BACKLIGHT CONTROL CIRCUIT

(71) Applicant: Radiant Opto-Electronics Corporation, Kaohsiung (TW)

(72) Inventors: Li-Fei Wang, Kaohsiung (TW); Yu-Lin Hsieh, Kaohsiung (TW); Sheng-Kai Fang, Kaohsiung (TW); Pei-Ling Kao, Kaohsiung (TW)

(73) Assignee: Radiant Opto-Electronics Corporation, Kaohsiung (TW)

( * ) Notice: Subject to any disclaimer, the term of this patent is extended or adjusted under 35 U.S.C. 154(b) by 0 days.

(21) Appl. No.: 17/897,243

(22) Filed: Aug. 29, 2022

(65) Prior Publication Data

US 2023/0077136 A1 Mar. 9, 2023

Related U.S. Application Data

(63) Continuation of application No. PCT/CN2021/115842, filed on Aug. 31, 2021.

(51) Int. Cl.
*G09G 3/34* (2006.01)

(52) U.S. Cl.
CPC ... *G09G 3/3426* (2013.01); *G09G 2320/0233* (2013.01); *G09G 2360/16* (2013.01)

(58) Field of Classification Search
CPC ..... G09G 3/3426; G09G 2320/0233; G09G 2360/16
See application file for complete search history.

(56) References Cited

U.S. PATENT DOCUMENTS

| | | | | |
|---|---|---|---|---|
| 7,795,821 | B2 * | 9/2010 | Jun | G09G 3/3426 315/308 |
| 11,211,018 | B1 * | 12/2021 | Sun | G09G 3/3426 |
| 11,475,865 | B2 * | 10/2022 | Chappalli | G09G 3/2003 |
| 11,594,189 | B2 * | 2/2023 | Rajamani | G09G 3/3406 |
| 2007/0115228 | A1 * | 5/2007 | Roberts | G09G 3/3413 345/82 |

(Continued)

FOREIGN PATENT DOCUMENTS

| | | | |
|---|---|---|---|
| CN | 101055376 | A | 10/2007 |
| CN | 101192375 | A | 6/2008 |

(Continued)

*Primary Examiner* — Gene W Lee
(74) *Attorney, Agent, or Firm* — Winston Hsu

(57) ABSTRACT

A backlight control method for a surface light-emitting device is provided. The backlight control method includes generating a plurality of driving currents to drive the surface light-emitting device such that a plurality of backlight zones generate a plurality of brightness values, measuring the plurality of brightness values of the plurality of backlight zones, calculating a plurality of uniformities of the plurality of backlight zones according to the plurality of brightness values and setting a plurality of target uniformities, generating a plurality of adjustment values according to the plurality of uniformities, the plurality of target uniformities and a plurality of adjustment coefficients corresponding to the plurality of backlight zones, and generating a plurality of adjusted driving currents to drive the plurality of backlight zones according to the plurality of adjustment values and the plurality of driving currents.

26 Claims, 11 Drawing Sheets

(56) References Cited

U.S. PATENT DOCUMENTS

| | | | | |
|---|---|---|---|---|
| 2009/0086473 | A1* | 4/2009 | Tan | G09G 3/3426 362/97.1 |
| 2010/0165002 | A1 | 7/2010 | Ahn | |
| 2012/0262940 | A1* | 10/2012 | Miyairi | G02B 6/0078 362/628 |
| 2013/0155125 | A1 | 6/2013 | Inamura | |
| 2019/0348001 | A1 | 11/2019 | Shi | |
| 2022/0101805 | A1* | 3/2022 | Hsu | G09G 3/3413 |
| 2023/0120576 | A1* | 4/2023 | Olchovik | G09G 3/3426 345/102 |

FOREIGN PATENT DOCUMENTS

| | | | |
|---|---|---|---|
| CN | 101763838 | A | 6/2010 |
| CN | 101894524 | A | 11/2010 |
| CN | 102235624 | A | 11/2011 |
| CN | 102282603 | A | 12/2011 |
| CN | 103606353 | A | 2/2014 |
| CN | 104011786 | A | 8/2014 |
| CN | 106205506 | A | 12/2016 |
| CN | 212516503 | U | 2/2021 |
| CN | 113129846 | A | 7/2021 |
| JP | 2010-54726 | A | 3/2010 |
| TW | 201123145 | A1 | 7/2011 |
| TW | M607910 | U | 2/2021 |

* cited by examiner

| BC1 | BC2 | BC3 | BC4 | BC5 | |
|---|---|---|---|---|---|
| 0.919 | 0.947 | 0.987 | 0.96 | 0.961 | BR1(G1) |
| 0.923 | 1.029 | 1.006 | 1.028 | 0.975 | BR2(G2) |
| 0.944 | 1.028 | 1.015 | 1.017 | 0.958 | BR3(G3) |
| 0.969 | 1.024 | 1.017 | 1.024 | 0.949 | BR4(G4) |
| 0.971 | 0.992 | 0.972 | 0.983 | 0.918 | BR5(G5) |

FIG. 4

| BC1 | BC2 | BC3 | BC4 | BC5 | |
|---|---|---|---|---|---|
| 0.85 | 0.85 | 0.85 | 0.85 | 0.85 | BR1(G1) |
| 0.85 | 0.859 | 0.859 | 0.859 | 0.85 | BR2(G2) |
| 0.85 | 0.91 | 1 | 0.97 | 0.85 | BR3(G3) |
| 0.85 | 0.859 | 0.859 | 0.85 | 0.85 | BR4(G4) |
| 0.85 | 0.85 | 0.85 | 0.85 | 0.85 | BR5(G5) |

FIG. 5

| BC1 | BC2 | BC3 | BC4 | BC5 | |
|---|---|---|---|---|---|
| 40 | 32.407 | 31.031 | 31.896 | 40 | BR1(G1) |
| 32.688 | 26.321 | 26.208 | 25.511 | 30.857 | BR2(G2) |
| 31.717 | 25.239 | 26.359 | 25.44 | 32.049 | BR3(G3) |
| 29.92 | 25.721 | 26.13 | 26.194 | 32.258 | BR4(G4) |
| 40 | 31.299 | 32.612 | 32.708 | 40 | BR5(G5) |

FIG. 8

BACKLIGHT CONTROL METHOD AND BACKLIGHT CONTROL CIRCUIT

CROSS REFERENCE TO RELATED APPLICATIONS

This application is a continuation application of PCT Application No. PCT/CN2021/115842, filed on Aug. 31, 2021. The content of the application is incorporated herein by reference.

BACKGROUND OF THE INVENTION

1. Field of the Invention

The present invention relates to a backlight control method and a backlight control circuit, and more particularly, to a backlight control method and a backlight control circuit capable of improving display uniformity.

2. Description of the Prior Art

With advancements in technology, liquid crystal displays (LCDs) are widely applied in various electronic products, e.g., notebooks, tablets, mobile phones, televisions. The electronic product equipped with the LCD has become an indispensable part of people's daily life. In general, images may be displayed through the LCD while using the electronic product, so as to allow the user to view the images displayed on the LCD. Since the display panel does not emit light itself, the LCD is usually equipped with a backlight module for providing required light sources to display the image. For example, light-emitting diodes (LEDs) offer advantages of energy savings, long device life time, no mercury used, high achievable color gamut, without idle time and fast response speed, so that the LED technology has been widely applied in fields of light sources for display and illumination. However, the problems of uneven brightness and darkness often occur in the conventional backlight device, thus resulting in dark bands at the corners or dark lines at the edges of the appearance. Besides, the brightness uniformity of the backlight device also does not meet the specification requirements. Further, as the size of the display device becomes larger, the power consumption of the backlight device may increase. A conventional method for solving the above problems is to change the arrangement of the light sources. For example, the pitches of the light sources in alight source array may be changed for improving the uniformity. Another conventional method for solving the above problems is to employ the configurations of different levels of light sources by using the light source allocation (Bin) technique. However, the conventional methods still have the disadvantages of high material cost of light source components and long production time. Thus, how to solve the above-mentioned problems has become an important issue in the field.

SUMMARY OF THE INVENTION

It is therefore an objective of the present invention to provide a backlight control method and a backlight control circuit capable of improving display uniformity, to solve the above-mentioned problems.

According to an aspect of an embodiment, a backlight control method and a backlight control circuit for a surface light-emitting device is disclosed. The surface light-emitting device comprises a plurality of first groups and a plurality of second groups. Each of the first groups and the second groups comprises at least one backlight zone. Backlight zones arranged along a first direction are defined as the first group. Backlight zones arranged along a second direction are defined as the second group. The first direction is not parallel to the second direction. The backlight control method includes generating a plurality of driving currents to drive the surface light-emitting device such that a plurality of backlight zones generate a plurality of brightness values; measuring the plurality of brightness values of the plurality of backlight zones; calculating a plurality of uniformities of the plurality of backlight zones according to the plurality of brightness values and setting a plurality of target uniformities; generating a plurality of adjustment values according to the plurality of uniformities, the plurality of target uniformities and a plurality of adjustment coefficients corresponding to the plurality of backlight zones, such that the driving circuit is configured to generate a plurality of adjusted driving currents to drive the plurality of backlight zones according to the plurality of adjustment values and the plurality of driving currents.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 4 is a schematic diagram illustrating the uniformity of the backlight zones according to an embodiment of the present invention.

FIG. 5 is a schematic diagram illustrating the target uniformity of the backlight zones according to an embodiment of the present invention.

FIG. 8 is a schematic diagram illustrating the adjusted driving currents of the backlight zones according to an embodiment of the present invention.

DETAILED DESCRIPTION

Figure 1:
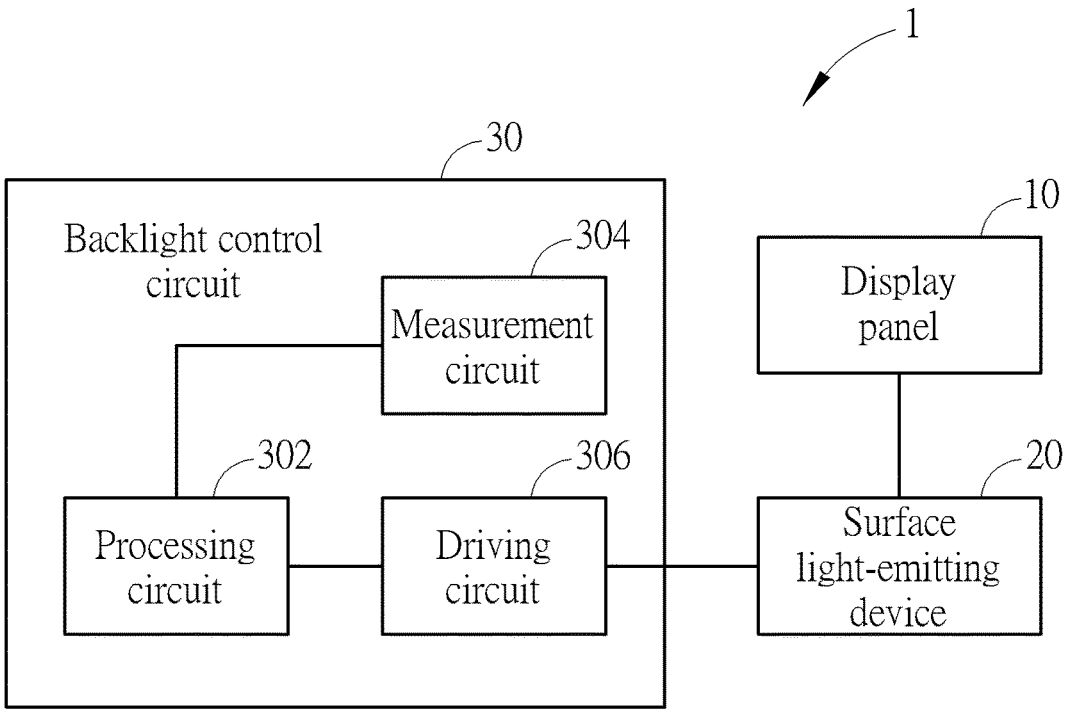
FIG. 1 is a schematic diagram of a display apparatus according to an embodiment of the present invention.
Figure 2:
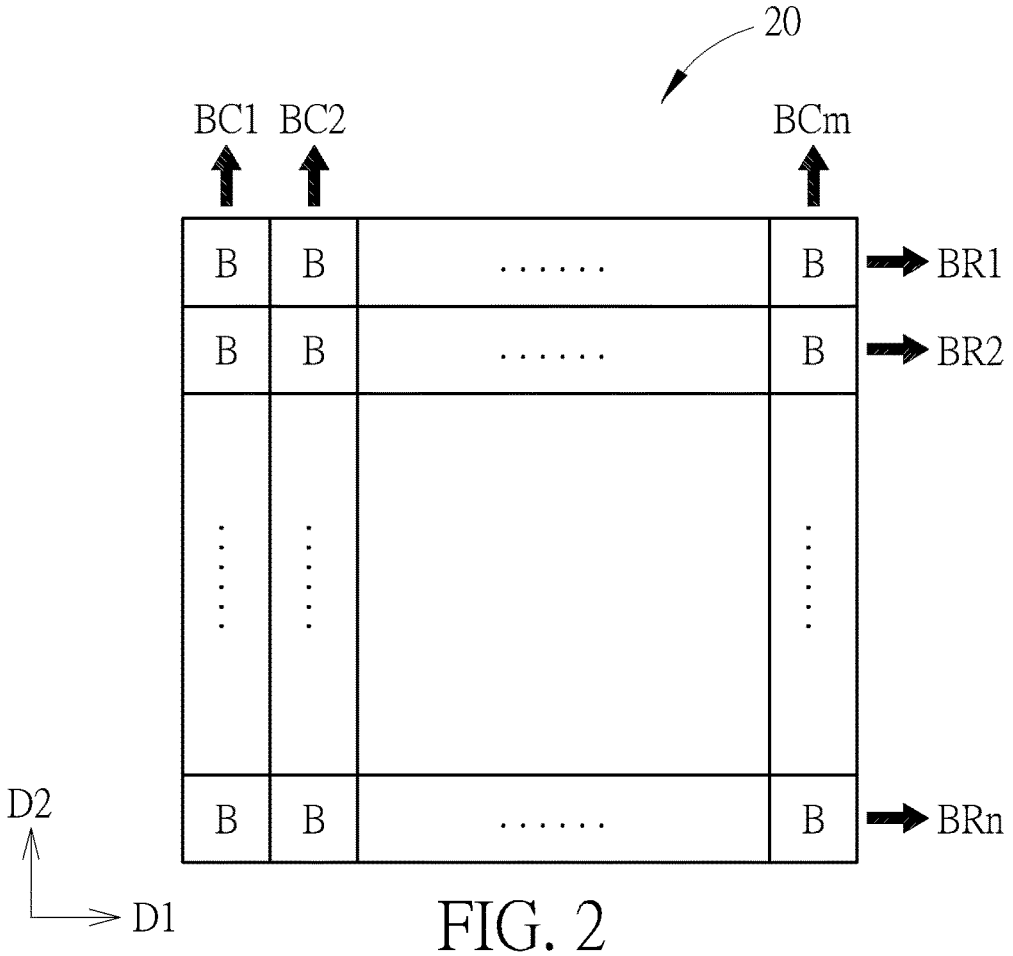
FIG. 2 is a schematic diagram of a surface light-emitting device shown in FIG. 1 according to an embodiment of the present invention.

Please refer to FIG. 1, which is a schematic diagram of a display apparatus 1 according to an embodiment of the present invention. The display apparatus 1 includes a display panel 10, a surface light-emitting device 20 and a backlight control circuit 30. The display panel 10 may be an LCD panel, and this should not be a limitation of the invention. The display panel 10 may be disposed above the surface light-emitting device 20. The surface light-emitting device 20 is utilized for providing backlight sources for the display panel 10. For example, please refer to FIG. 2, which is a schematic diagram of the surface light-emitting device 20 according to an embodiment of the present invention. The surface light-emitting device 20 may be divided into a plurality of backlight zones B. The plurality of backlight zones B of the surface light-emitting device 20 may correspond to the overall display area of the display panel 10. The plurality of backlight zones B may be utilized for providing backlight sources for the overall display area of the display panel 10. The backlight zones arranged along a direction D1 (i.e. first direction) may be defined as a zone row, or referred to as a first group. The backlight zones arranged along a direction D2 (i.e. second direction) may be defined as a zone column, or referred to as a second group. The direction D1 is not parallel to the direction D2. Each of the zone rows and the zone columns includes at least one backlight zone. As shown in FIG. 2, the surface light-emitting device 20 includes zone rows BR1 to BRn and zone columns BC1 to BCm. Each zone row includes m backlight zones. Each zone column includes n backlight zones. Each backlight zone includes at least one light source, and the light emitted from the at least one light source illuminates the display panel 10.

The backlight control circuit 30 is coupled to the surface light-emitting device 20 for driving the surface light-emitting device 20, such that the surface light-emitting device 20 provides the uniform backlight source for the display panel 10. The backlight control circuit 30 includes a processing circuit 302, a measurement circuit 304 and a driving circuit 306. The measurement circuit 304 is utilized for measuring brightness of the backlight zones of the surface light-emitting device 20. For example, the measurement circuit 304 may include an image sensor (not shown in figures). The image sensor may be a charge-coupled device (CCD) image sensor or a complementary metal-oxide semiconductor (CMOS) image sensor, but not limited thereto. The driving circuit 306 is utilized for generating a plurality of driving currents, a plurality of pre-driving currents or a plurality of adjusted driving currents for driving the surface light-emitting device 20. The driving circuit 306 may be a pulse width modulation (PWM) circuit. The processing circuit 302 is coupled to the measurement circuit 304 and the driving circuit 306 for generating a plurality of adjustment values corresponding to the plurality of backlight zones, so that the driving circuit 306 is configured to generate a plurality of adjusted driving currents to drive the plurality of backlight zones according to the plurality of adjustment values and the plurality of driving currents. In addition, the display apparatus 1 further includes a display driving circuit (not shown in figures) for controlling image display operations of the display panel 10.

Figure 3:
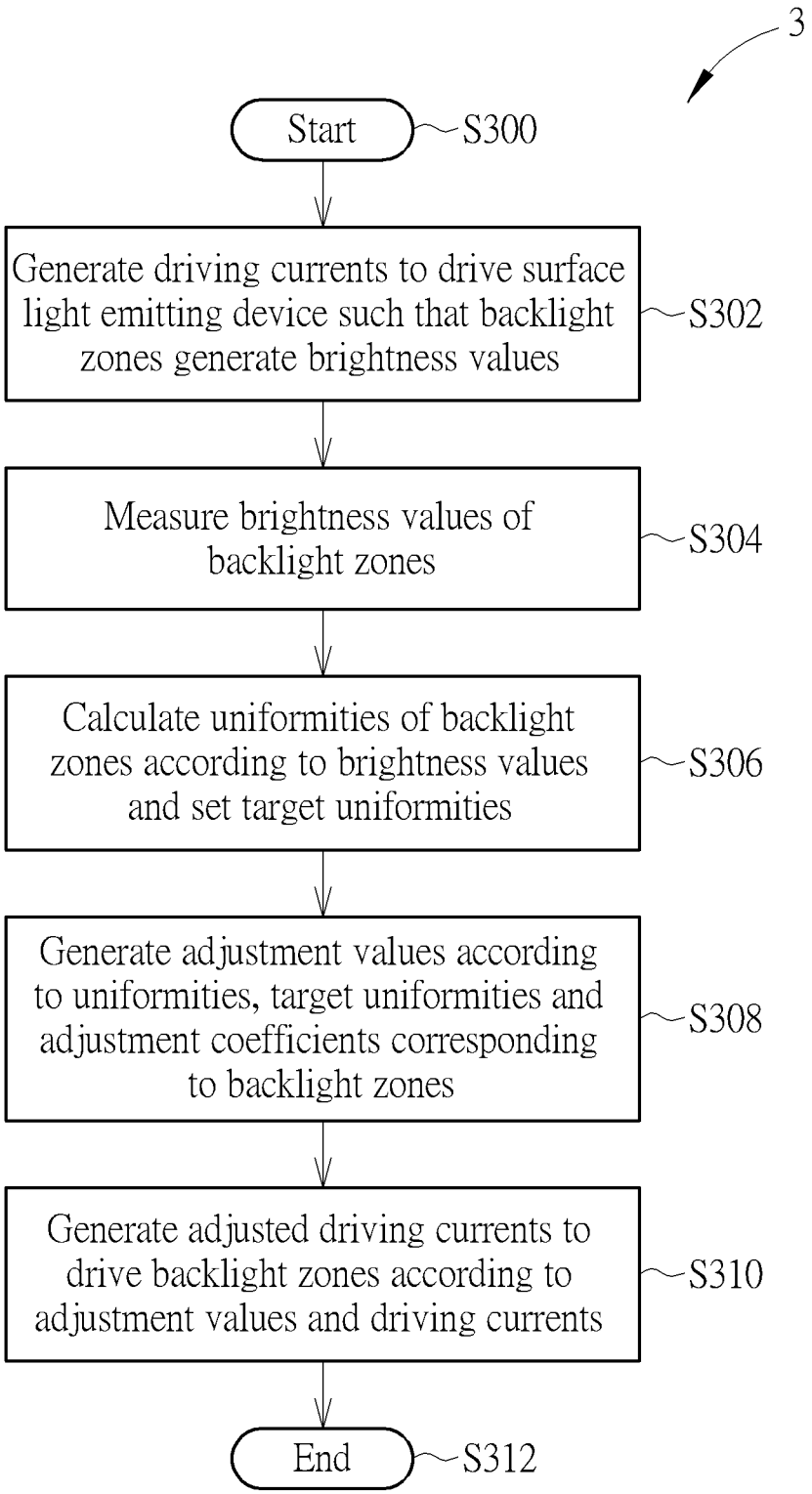
FIG. 3 is a flow diagram of a procedure according to a first embodiment of the present invention.

Regarding operations of the display apparatus 1, an operation method of the display apparatus 1 may be summarized in an exemplary procedure 3. Please refer to FIG. 3. FIG. 3 is a flow diagram of the procedure 3 according to an embodiment of the present invention. The procedure 3 includes the following steps:

Step S300: Start.

Step S302: Generate a plurality of driving currents to drive the surface light-emitting device such that a plurality of backlight zones generate a plurality of brightness values.

Step S304: Measure the plurality of brightness values of the plurality of backlight zones.

Step S306: Calculate a plurality of uniformities of the plurality of backlight zones according to the plurality of brightness values and set a plurality of target uniformities.

Step S308: Generate a plurality of adjustment values according to the plurality of uniformities, the plurality of target uniformities and a plurality of adjustment coefficients corresponding to the plurality of backlight zones.

Step S310: Generate a plurality of adjusted driving currents to drive the plurality of backlight zones according to the plurality of adjustment values and the plurality of driving currents.

Step S312: End.

According to the procedure 3, in Step S302, the driving circuit 306 generates a plurality of driving currents to drive the surface light-emitting device 20 such that a plurality of backlight zones of the surface light-emitting device 20 generate a plurality of brightness values. In Step S304, the measurement circuit 304 measures the plurality of brightness values of the plurality of backlight zones of the surface light-emitting device 20. For example, the measurement circuit 304 measures a respective brightness value for each backlight zone. Each backlight zone has a corresponding brightness value.

In Step S306, the processing circuit 302 calculates a plurality of uniformities of the plurality of backlight zones of the surface light-emitting device 20 according to the plurality of brightness values, and sets a plurality of target uniformities for the plurality of backlight zones. The processing circuit 302 calculates the uniformity of each backlight zone according to the plurality of brightness values corresponding to the backlight zones measured by the measurement circuit 304. For example, the processing circuit 302 sets a target brightness value for each backlight zone and calculates a ratio of a brightness value of the each backlight zone to a maximum of the plurality of target brightness values of the plurality of backlight zones so as to obtain a uniformity of the each backlight zone. As shown in FIG. 4, taking the surface light-emitting device 20 with 5 by 5 backlight zones for example, the surface light-emitting device 20 includes zone rows BR1 to BR5 and zone columns BC1 to BC5. The processing circuit 302 calculates the uniformity of each backlight zone. As shown in FIG. 4, the number in each backlight zone represents the corresponding uniformity of the backlight zone. As the uniformity is greater than 1, this means that the brightness value of the backlight zone is greater than the maximum target brightness value among the plurality of target brightness values.

Moreover, in Step S306, the processing circuit 302 may query a target brightness value table to obtain the corresponding target brightness value of each backlight zone. The target brightness value table may be stored in a lookup table available in the storage device (not shown in figures) of the display apparatus 1. The processing circuit 302 may query the target brightness value table stored in the storage device to determine the corresponding target brightness value of each backlight zone. As the target brightness value of each backlight zone is set, the processing circuit 302 calculates the target uniformity of each backlight zone according to the plurality of target brightness values corresponding to the plurality of backlight zones. For example, the processing circuit 302 determines a maximum target brightness value among the plurality of target brightness values of the plurality of backlight zones of the surface light-emitting device 20. For each backlight zone, the processing circuit 302 calculates a ratio of a target brightness value of the each backlight zone to a maximum target brightness value of the plurality of target brightness values so as to obtain a target uniformity of the each backlight zone. As shown in FIG. 5, the processing circuit 302 calculates the target uniformity of the each backlight zone. The number in each backlight zone represents the corresponding target uniformity of the backlight zone. The target uniformity of the backlight zone in the center of the surface light-emitting device 20 is equal to 1, and the target uniformity of all other backlight zones is less than 1. This means that the brightness of the backlight zone in the middle is designed to achieve the maximum brightness and the brightness of the backlight zones in the surrounding may decrease according to the requirements.

In another embodiment, the processing circuit 302 obtains a target uniformity of a central backlight zone of the surface light-emitting device 20. The central backlight zone may be located at or near a center of the surface light-emitting device 20. Moreover, the central backlight zone may be located at an intersection of a zone row and a zone column. The processing circuit 302 obtains target uniformities of backlight zones on both side edges of a zone row including the central backlight zone in the plurality of zone rows and calculates the target uniformity of each backlight zone of the zone row according to an equation. Further, the processing circuit 302 obtains target uniformities of backlight zones on both side edges of a zone column including the central backlight zone in the plurality of zone columns and accordingly calculates the target uniformity of each backlight zone of the zone column according to an equation, the target uniformity of the central backlight zone and the target uniformities of the backlight zones on the both sides of the zone column.

Figure 6:
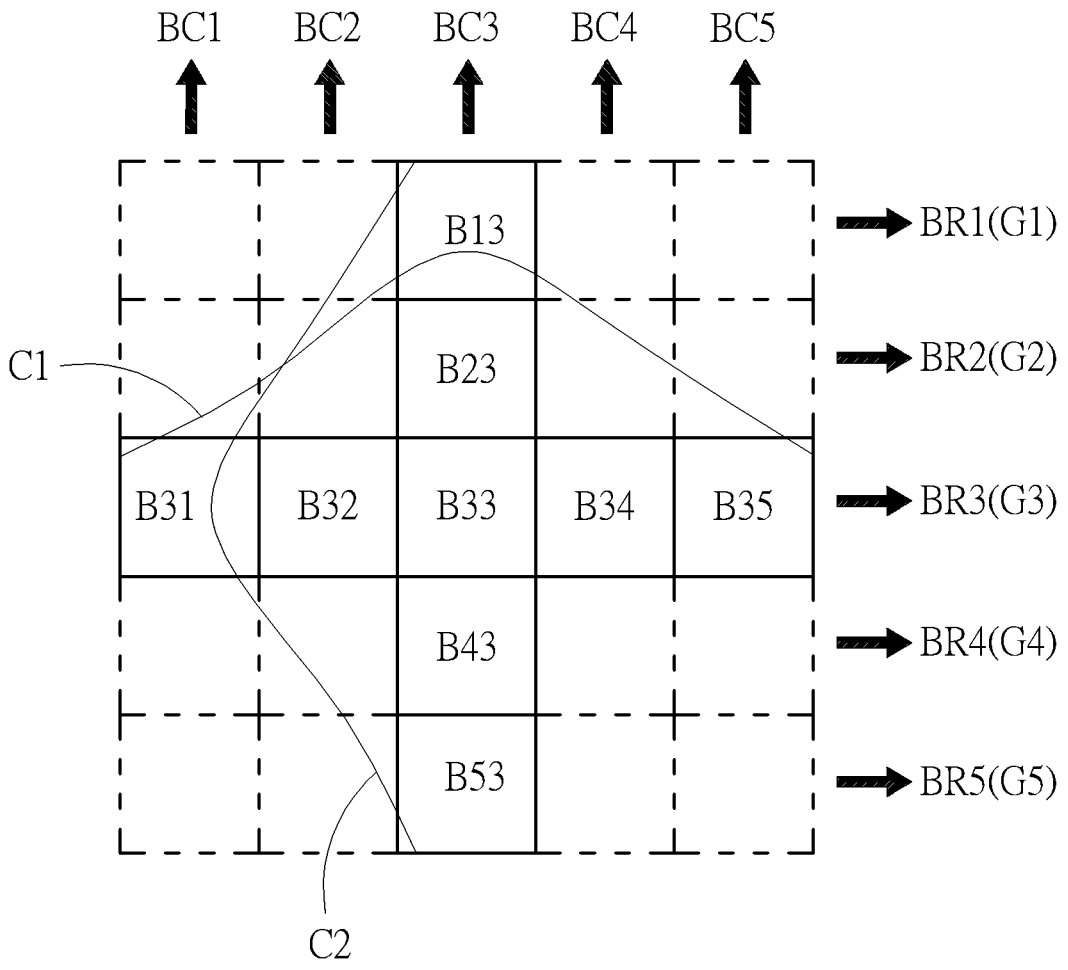
FIG. 6 is a schematic diagram illustrating an operation of the target uniformity of the backlight zones according to an embodiment of the present invention.

For example, please refer to FIG. 6. FIG. 6 is a schematic diagram illustrating an operation of the target uniformity of the backlight zone according to an embodiment of the present invention. Taking the surface light-emitting device 20 with five by five backlight zones for example, as shown in FIG. 6, the backlight zone B33 may be determined as the central backlight zone. The backlight zone B33 is located at an intersection of the zone row BR3 and the zone column BC3 of the surface light-emitting device 20. The processing circuit 302 obtains the target uniformity of the backlight zone B33 (i.e., central backlight zone) and the target uniformities of the backlight zones (i.e., backlight zones B31 and B35) on both side edges of the zone row BR3 including the backlight zone B33. For example, the processing circuit 302 may calculate target brightness values of the backlight zones B33, B31 and B35 by using the above-mentioned method according to predetermined target brightness values of the backlight zones B33, B31 and B35. The predetermined target brightness values may be preset. For example, the target uniformities of the backlight zones B33, B31 and B35 may be preset or obtained by querying the look-up table. The processing circuit 302 may calculate the target uniformity of each backlight zone of the zone row BR3 according to an equation F1 and the target uniformities of the backlight zones B33, B31 and B35. For example, the processing circuit 302 may perform a curve fitting operation on the target uniformities of the backlight zones B33, B31 and B35 based on the equation F1 to obtain the target uniformities of the backlight zones B32 and B34. As shown in FIG. 6, C1 represents the curve of equation F1. In an embodiment, the curve C1 may be a curve of the equation F1 of a normal distribution, but not limited thereto.

Moreover, please further refer to FIG. 6, the processing circuit 302 obtains the target uniformities of the backlight zones (i.e., backlight zones B13 and B53) on both side edges of the zone column BC3 including the central backlight zone B33 and the target uniformity of the backlight zone B33. The processing circuit 302 may perform a curve fitting operation on the target uniformities of the backlight zones B33, B13 and B53 based on an equation F2 to obtain the target uniformities of the backlight zones B23 and B43. As shown in FIG. 6, C2 represents the curve of equation F2. In an embodiment, the curve C2 may be a curve of the equation F2 of a normal distribution, but not limited thereto. As a result, the processing circuit 302 may set the target uniformities of the backlight zones of the zone row BR3 and the zone column BC3 including the central backlight zone B33. Similarly, the processing circuit 302 may set the target uniformities of the backlight zones of each zone row and zone column of the surface light-emitting device 20. Regarding the central backlight zone located at the intersection of the zone row BR3 and the zone column BC3. The target uniformity of the central backlight zone is the same value whether in the curve C1 or curve C2 so as to ensure that the brightness of the backlight zone in the middle is designed to achieve the maximum brightness and the brightness of the backlight zones in the surrounding decreases according to the equations F1 and F2. In addition, when the equations F1 and F2 are normally distributed, the brightness of the backlight zones in the surrounding may be decreased in a smooth manner without dropping rapidly and sharply.

Figure 7:
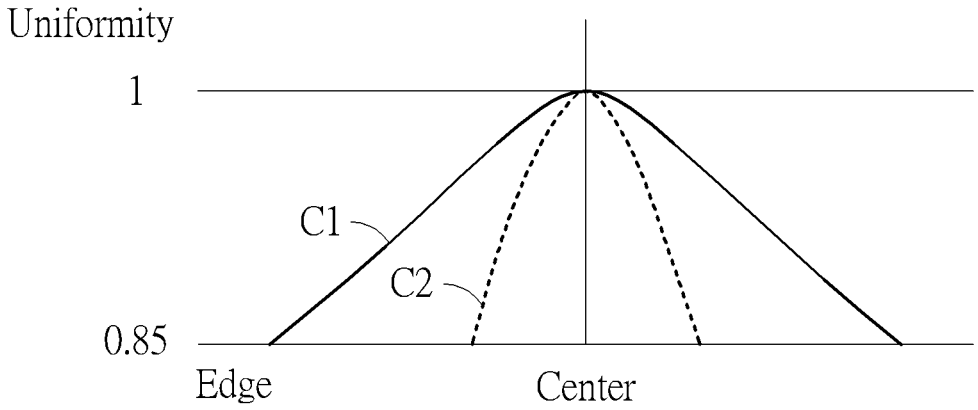
FIG. 7 is a schematic diagram illustrating curves of curve fitting operation for the surface light-emitting device with an aspect ratio according to embodiments of the present invention.

When applied to the surface light-emitting device 20 with an aspect ratio, a backlight zone located at or near a center of the surface light-emitting device 20 and located at an intersection of a zone row and a zone column may be defined as a central backlight zone. A maximum distance between the backlight zone closest to the edge among the plurality of zone rows of the surface light-emitting device 20 and the central backlight zone may be greater than a maximum distance between the backlight zone closest to the edge among the plurality of zone columns of the surface light-emitting device 20 and the central backlight zone. Moreover, an adjustment value corresponding to the backlight zone closest to the edge among the plurality of zone rows may be greater than an adjustment value corresponding to the backlight zone closest to the edge among the plurality of zone columns. In other words, the zone rows are arranged along the short axis direction, and the zone columns are arranged along the long axis direction. Please refer to FIG. 7. FIG. 7 is a schematic diagram illustrating curves C1 and C2 of curve fitting operation for the surface light-emitting device 20 with the aspect ratio according to embodiments of the present invention. The number of zone columns is greater than the number of zone rows. As shown in FIG. 7, the curve C1 may lie across more zone columns and the distance between the edge backlight zone and the central backlight zone is longer, the brightness need not be rapidly increased from low brightness of the edge backlight zone to high brightness of the central backlight zone, such that the curve C1 rises from the edge backlight zone toward the central backlight zone with a smaller (flatter) curvature. As shown in FIG. 7, the curve C2 may lie across less zone rows and the distance between the edge backlight zone and the central backlight zone is shorter, the brightness need be rapidly increased from low brightness of the edge backlight zone to high brightness of the central backlight zone, such that the curve C2 rises from the edge backlight zone toward the central backlight zone with a larger (steeper) curvature.

For the surface light-emitting device 20 with an aspect ratio, the uniformities of the backlight zones (except central backlight zone and edge backlight zones) on the same zone row may be determined by using the curve C1 with a smaller (flatter) curvature and the corresponding equation F1 based on the uniformities of the central backlight zone and the edge backlight zones. The uniformities of the backlight zones (except central backlight zone and edge backlight zones) on the same zone column may be determined by performing a curve fitting operation according to the uniformities of the central backlight zone and the edge backlight zones on the same zone column. The result of curve fitting is the curve C2 with larger (steeper) curvature. Therefore, when the surface light-emitting device 20 is designed with an aspect ratio of 16:9 or 16:10, the surface light-emitting device 20 may offer a gentle change of uniformity in the direction of horizontal long axis for the user, which is suitable for all types of products with large viewing angles, such as televisions, displays, notebooks and vehicle-mounted devices.

In Step S308, the processing circuit 302 generates a plurality of adjustment values according to the plurality of uniformities, the plurality of target uniformities and a plurality of adjustment coefficients corresponding to the plurality of backlight zones. For example, the backlight zones of each zone row correspond to a corresponding adjustment coefficient. The plurality of adjustment coefficients may be different. The plurality of adjustment values corresponding to the backlight zones of the surface light-emitting device 20 may be calculated by the processing circuit 302 according to the following equation:

$$A_{i,k} = \left(\frac{UT_{i,k}}{U_{i,k}}\right)^{G_K} \tag{1}$$

where $A_{i,k}$ represents an adjustment value of i-th backlight zone of k-th first group, $UT_{i,k}$ represents a target uniformity of the i-th backlight zone of the k-th first group, $U_{i,k}$ represents a uniformity of the i-th backlight zone of the k-th first group, $G_k$ represents an adjustment coefficient corresponding to the k-th first group, and i is between 1 and m, k is between 1 and n, $G_k$ is a real number.

Please further refer to FIG. 4 and FIG. 5. The adjustment coefficients G1 to G5 correspond to the zone rows BR1 to BR5. The processing circuit 302 may calculate a uniformity ratio by dividing a target uniformity of a backlight zone of each zone row by a uniformity of the backlight zone, and perform an exponentiation operation on the uniformity ratio with a power of the corresponding adjustment coefficient to generate an adjustment value corresponding to the backlight zone of the zone row. For example, for zone row BR1, the adjustment value of each backlight zone in the zone row BR1 may be calculated by the processing circuit 302 according to the following equation:

$$A_{i,1} = \left(\frac{UT_{i,1}}{U_{i,1}}\right)^{G_1} \tag{2}$$

where $A_{i,1}$ represents an adjustment value of i-th backlight zone of zone row BR1, $UT_{i,1}$ represents a target uniformity of the i-th backlight zone of the zone row BR1, $U_{i,1}$ represents a uniformity of the i-th backlight zone of the zone row BR1, $G_1$ represents an adjustment coefficient corresponding to the zone row BR1, and i is between 1 and m.

The operations of generating the adjustment values of the backlight zones of zone rows BR2 to BR5 are similar or identical to those operations of generating the adjustment value of the backlight zones of the zone row BR1 illustrated above, and further description is omitted here for brevity. Therefore, the processing circuit 302 may calculate the adjustment values of all backlight zones of the surface light-emitting device 20. Moreover, since the adjustment coefficient is a power (or called exponent) term of the exponential equation, the change of the adjustment value may increase exponentially in response to the adjustment coefficient, rather than increase linearly. When the uniformity ratio of the backlight zone is greater than one, the adjustment value may be increased rapidly and accordingly the corresponding current for driving the backlight zone may be increased so as to improve the brightness of the backlight zone.

Regarding the method of determining the adjustment coefficient, please refer to FIG. 6. The adjustment coefficient G3 may be determined according to the curve C1. For example, the adjustment coefficient G3 is the curvature of the curve C1. For the zone columns BC1 to BC5, taking the zone column BC3 for example, the adjustment coefficient of the zone column BC3 may be the curvature of the curve C2. Further, when the surface light-emitting device 20 is a square as shown in FIG. 6, the curvatures of the curves C1 and C2 are the same. When the surface light-emitting device is a rectangle as shown in FIG. 7, the curvature of the curve C1 on the long axis is smaller than the curvature of the curve C2 on the short axis.

The backlight zones of each zone row correspond to a corresponding adjustment coefficient. The plurality of adjustment coefficients are real numbers. The plurality of adjustment coefficients may be different. For example, the adjustment coefficient G1 is different from the adjustment coefficient G2. A backlight zone located at or near a center of the surface light-emitting device 20 and located at an intersection of a zone row and a zone column may be defined as a central backlight zone. For example, please further refer to FIG. 6, the backlight zone B33 may be a central backlight zone. As a minimum distance between the backlight zone of a first zone row of the plurality of zone rows of the surface light-emitting device 20 and the central backlight zone is smaller than a minimum distance between the backlight zone of a second zone row of the plurality of zone rows of the surface light-emitting device 20 and the central backlight zone, the adjustment coefficient corresponding to the backlight zones of the first zone row of the plurality of zone rows is greater than the adjustment coefficient corresponding to the backlight zones of the second zone row of the plurality of zone rows.

For example, please further refer to FIG. 4 to FIG. 6, the backlight zone B33 is the central backlight zone. A minimum distance L1 between the zone row BR1 and the backlight zone B33 is two backlight zones (i.e., the vertical distance between the zone row BR1 and the backlight zone B33). A minimum distance L2 between the zone row BR2 and the backlight zone B33 is one backlight zone (i.e., the vertical distance between the zone row BR2 and the backlight zone B33). As such, the adjustment coefficient G2 corresponding to the zone row BR2 is greater than the adjustment coefficient G1 corresponding to the zone row BR1.

Figure 10:
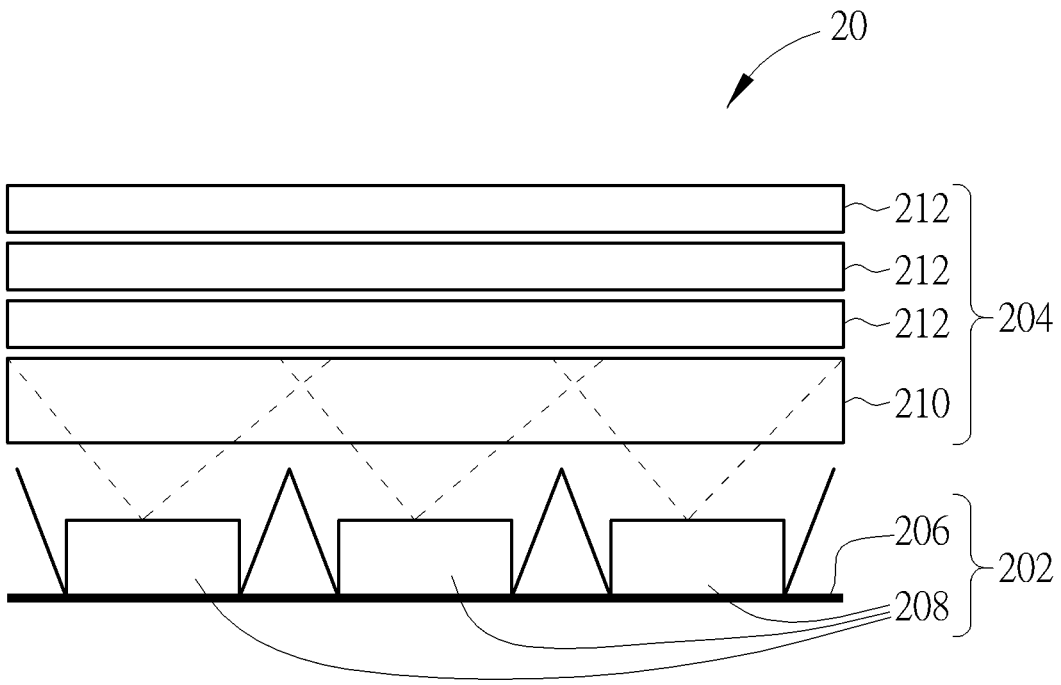
FIG. 10 is a schematic diagram of the surface light-emitting device shown in FIG. 1 according to an alternative embodiment of the present invention.

Please also refer to FIG. 10. A purpose of embodiments is that the closer to the edge the light source 208 is, the less the brightness is affected. That is, the closer to the edge the triangle dashed range shown in FIG. 10 is, the less the light is. As such, the response is flatter, and a smaller adjustment coefficient may be used. Alternatively, the closer to the center the light source 208 is, the larger the brightness is affected. The light may overlap each other in the center area of the triangle dashed range shown in FIG. 10, and a larger adjustment coefficient may be used. Therefore, the embodiments may fine-tune the uniformity or brightness of the backlight zones at different positions according to the actual brightness, and thus effectively optimizing the brightness distribution performance of the surface light-emitting device 20 and significantly improving the problem of uneven brightness.

In Step S310, the driving circuit 306 generates a plurality of adjusted driving currents to drive the plurality of backlight zones according to the plurality of adjustment values and the plurality of driving currents. The processing circuit 302 calculates the plurality of adjusted driving currents according to the adjustment values generated by Step S308 and the driving currents generated by Step S302. Accordingly, the driving circuit 306 generates the plurality of adjusted driving currents to drive the plurality of backlight zones of the surface light-emitting device 20. For each backlight zone, the driving circuit 306 generates an adjusted driving current corresponding to the each backlight zone. The adjusted driving current corresponding to the each backlight zone may be a product of an adjustment value corresponding to the each backlight zone and a driving current corresponding to the each backlight zone. For example, the adjusted driving current of each backlight zone may be calculated by the processing circuit 302 according to the following equation:

$$I'_{i,k}=A_{i,k}\times I_{i,k} \tag{3}$$

where $I'_{i,k}$ represents an adjusted driving current of i-th backlight zone of k-th zone row (BRk), $A_{i,k}$ represents an adjustment value of the i-th backlight zone of the k-th zone row, $I_{i,k}$ represents an original driving current (e.g., driving current used in Step S302) of the i-th backlight zone of the k-th zone row, and i is between 1 and m, k is between 1 and n.

Therefore, the processing circuit 302 calculates the adjusted driving current of each backlight zone. The driving circuit 306 generates the adjusted driving current of each backlight zone to drive each backlight zone of the surface light-emitting device 20. As shown in FIG. 8, the number in each backlight zone represent the adjusted drive current corresponding to the each backlight zone, in milliamps. In other words, the embodiments of the present invention generate the adjusted driving current by utilizing the corresponding adjustment coefficient and adjustment value, and thus improving the display uniformity, providing the brightness compensation of the dark area and the appearance compensation of the overall light-emitting surface, effectively optimizing the brightness distribution of the surface light-emitting device 20 and improving the problem of uneven brightness. Moreover, the curve of the adjusted driving currents of the embodiments of the present invention may be smoother and the overall power consumption may be effectively reduced.

Figure 9:
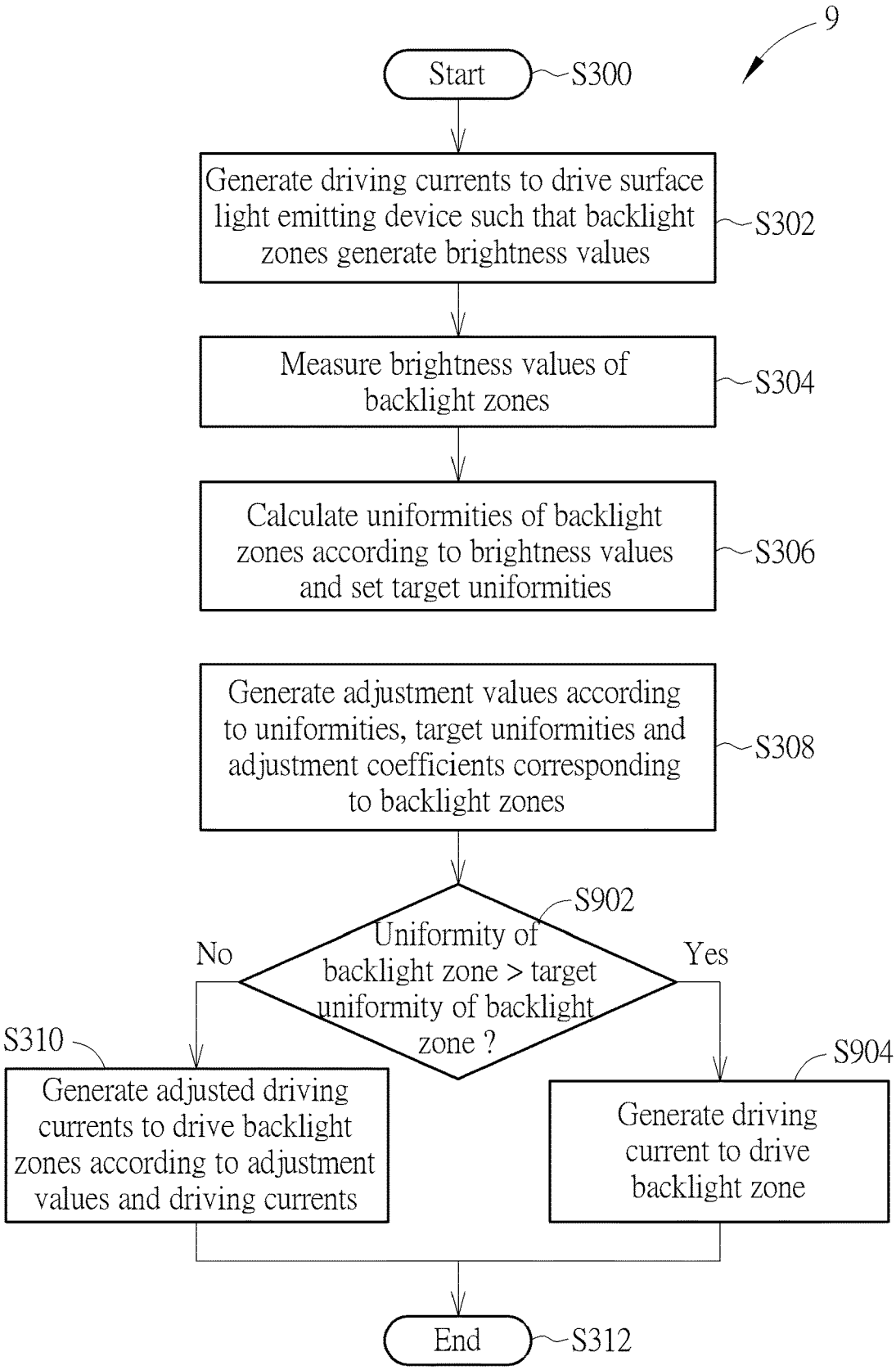
FIG. 9 is a flow diagram of a procedure according to a second embodiment of the present invention.

In another embodiment, please refer to FIG. 9. FIG. 9 is a flow diagram of a procedure 9 according to an embodiment of the present invention. Please note that the steps in the procedure 9 shown in FIG. 9 with the same steps numbers or designations as those in the procedure 3 shown in FIG. 3 have similar operations and functions, and further description thereof is omitted for brevity. As shown in FIG. 9, after Step S308, Step S902 is executed. In Step S902, the processing circuit 302 further determines whether the uniformity of each backlight zone is greater than the target uniformity of the each backlight zone. When the uniformity of the backlight zone is greater than the target uniformity of the each backlight zone (i.e., the uniformity ratio is smaller than one), Step S310 is not executed, the driving circuit 306 does not perform the step of generating the adjusted driving current for the backlight zone. This means, the backlight zone has sufficient brightness without decreasing the current value of the backlight zone to reduce the brightness of the backlight zone. For example, when the uniformity of the backlight zone is greater than the target uniformity of the backlight zone, Step S904 is executed, and the driving circuit 306 generates the driving current to drive the backlight zone. Step S904 is similar to Step S302. Therefore, for a backlight zone having the uniformity greater than the target uniformity, the driving circuit 306 generates an original driving current to drive the backlight zone without adjustment. For example, when the uniformity of the backlight zone is smaller than or equal to the target uniformity of the backlight zone (i.e., the uniformity ratio is greater than or equal to one), Step S310 is executed, the driving circuit 306 generates an adjusted driving current to drive the backlight zone. Since the adjustment coefficient is a power term of the exponential equation, the change of the adjustment value may increase exponentially in response to the adjustment coefficient, rather than increase linearly. When the uniformity ratio of the backlight zone is greater than one, the adjustment value may be increased rapidly and the current for driving the backlight zone may be increased accordingly so as to improve the brightness of the backlight zone.

Figure 11:
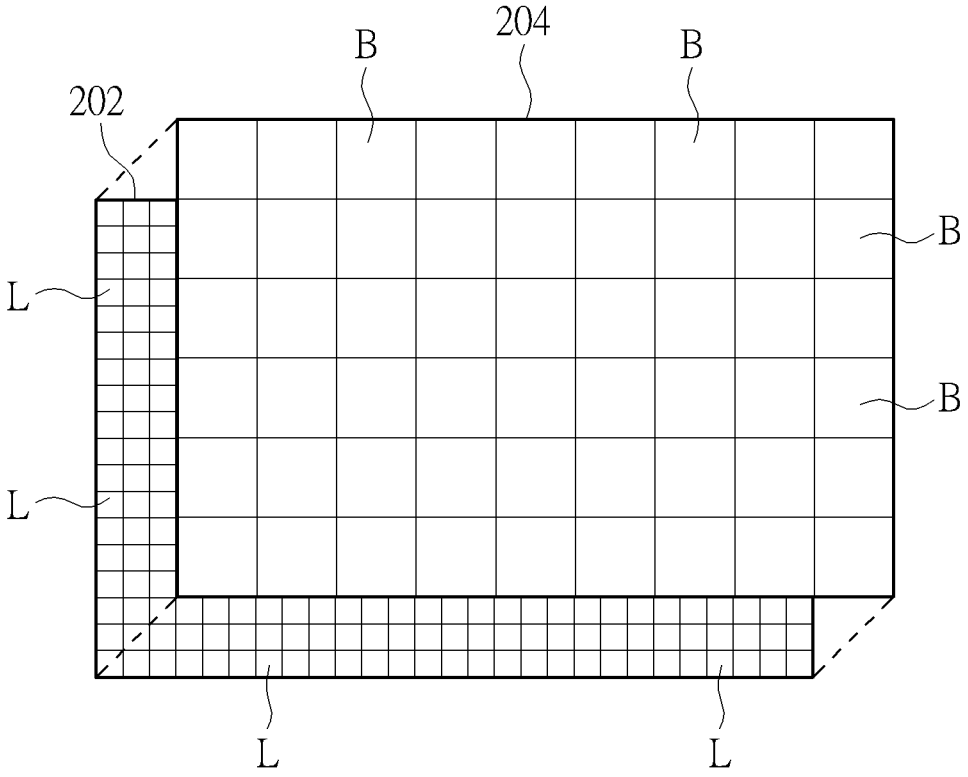
FIG. 11 is a schematic diagram illustrating the relationship of the backlight zones and the light-emitting zones according to an embodiment of the present invention.

Please refer to FIG. 10, which is a schematic diagram of the surface light-emitting device 20 according to an alternative embodiment of the present invention. The surface light-emitting device 20 includes a light source module 202 and a backlight module 204. The light source module 202 includes a substrate 206 and a plurality of light sources 208 disposed on the substrate 206. The light source 208 is utilized for emitting light. For example, the light source 208 may be realized with a light-emitting diode (LED), a mini LED or any other device capable of emitting light. The light emitted by the light source 208 illuminates the display panel 10. As shown in FIG. 10, the dashed line represents the light path. The backlight module 204 includes a diffusion plate 210 and an optical film 212. Please refer to FIG. 11, which is a schematic diagram illustrating the relationship of backlight zones and light-emitting zones according to an embodiment of the present invention. The backlight module 204 is arranged above the plurality of light sources 208, and the light source module 204 defines a plurality of backlight zones B. The light source module 202 defines a plurality of light-emitting zones L. Each light-emitting zone includes at least one light source 208. The number of the plurality of light-emitting zones is greater than or equal to the number of the plurality of backlight zones B.

Figure 12:
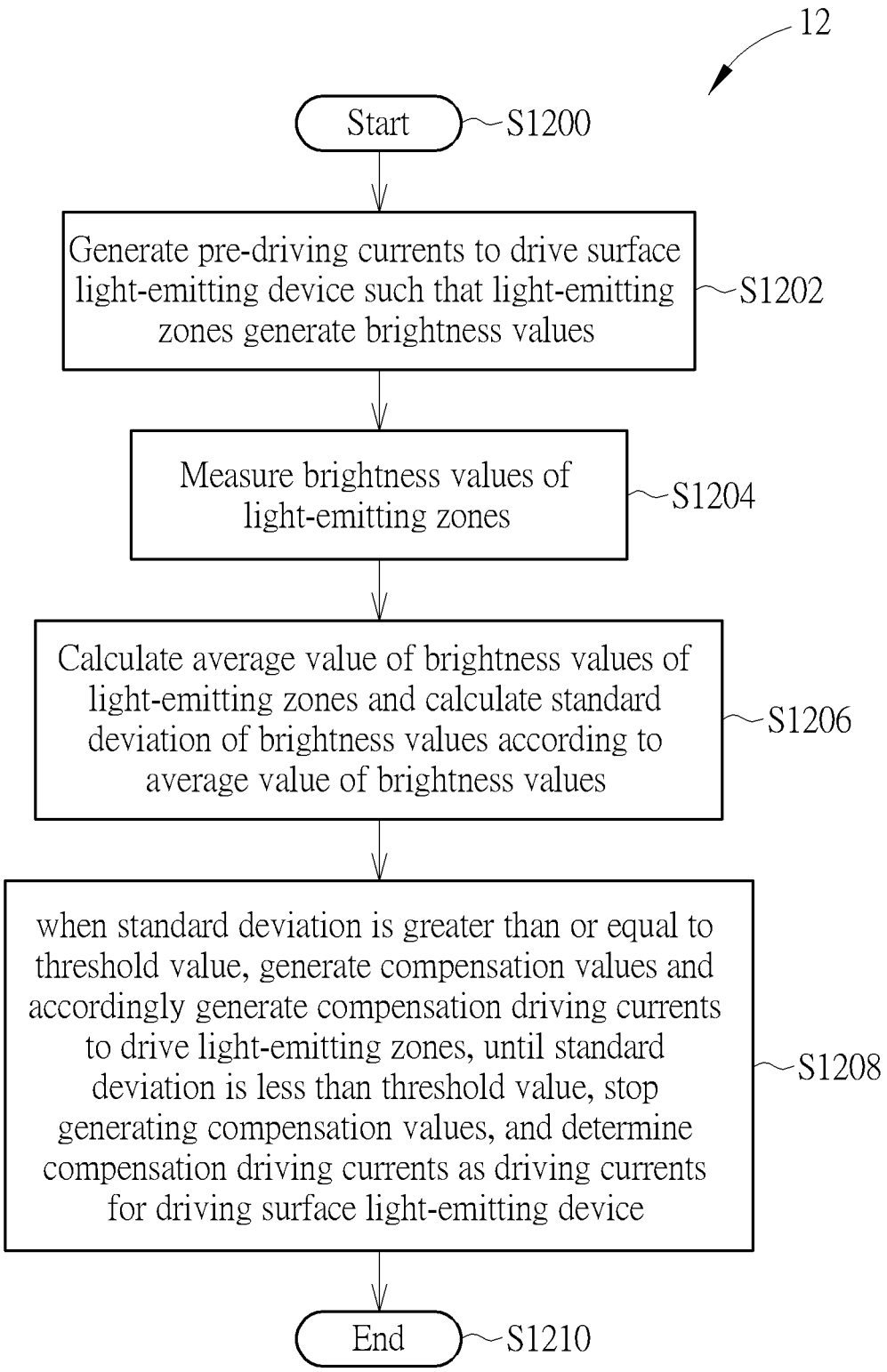
FIG. 12 is a flow diagram of a procedure according to a third embodiment of the present invention.

The procedure 3 shown in FIG. 3 may be applied based on the premise that the light source module 202 emits light uniformly. As the light source module 202 emits the light unevenly, the light source module 202 has to be corrected first in order to provide uniform illumination. Further description associated with the operations of calibrating the light source module 202 for uniform illumination is provided as follows. Please refer to FIG. 12. FIG. 12 is a flow diagram of a procedure 12 according to an embodiment of the present invention. The procedure 12 includes the following steps:

Step S1200: Start.

Step S1202: Generate a plurality of pre-driving currents to drive the surface light-emitting device such that a plurality of light-emitting zones generate a plurality of brightness values.

Step S1204: Measure the plurality of brightness values of the plurality of light-emitting zones.

Step S1206: Calculate an average value of the plurality of brightness values of the plurality of light-emitting zones and calculate a standard deviation of the plurality of brightness values according to the average value of the plurality of brightness values.

Step S1208: When the standard deviation is greater than or equal to a threshold value, generate a plurality of compensation values and accordingly generate a plurality of compensation driving currents to drive the plurality of light-emitting zones, until the standard deviation is less than the threshold value, stop generating the plurality of compensation values, and determine the plurality of compensation driving currents as the plurality of driving currents for driving the surface light-emitting device.

Step S1210: End.

According to the procedure 12, in Step S1202, the driving circuit 306 generates a plurality of pre-driving currents to drive the surface light-emitting device 20 such that the plurality of light-emitting zones of the surface light-emitting device 20 generate the plurality of brightness values. In Step S1204, the measurement circuit 304 measures the plurality of brightness values of the plurality of light-emitting zones in the surface light-emitting device 20. In Step S1206, the processing circuit 302 calculates an average value of the plurality of brightness values generated by the plurality of light-emitting zones of the light source module 202, and calculates a standard deviation of the plurality of brightness values according to the average value of the plurality of brightness values. In Step S1208, when the standard deviation is greater than or equal to a threshold value, the processing circuit 302 generates a plurality of compensation values, and combines and converts the plurality of compensation values and the plurality of pre-driving currents into a plurality of compensation driving currents. As such, the driving circuit 306 generates the plurality of compensation driving currents to drive the plurality of light-emitting zones of the surface light-emitting device 20 so as to improve the bright area and the dark area to meet the standard requirement and solve the problem that the bright area is too bright and the dark area is too dark. Until the standard deviation is less than the threshold value, the processing circuit 302 stops generating the plurality of compensation values, and determines the plurality of compensation driving currents for acting as the plurality of driving currents generated by the step S302 in the procedure 3. The procedure 12 may be applied to obtain a plurality of driving currents before the procedure 3 is executed so as to meet the requirement of uniform brightness more quickly and effectively.

Those skilled in the art should readily make combinations, modifications and/or alterations on the above-mentioned description and examples. The above-mentioned descriptions, steps, procedures and/or processes including suggested steps may be realized by means that could be hardware, software, firmware (known as a combination of a hardware device and computer instructions and data that reside as read-only software on the hardware device), an electronic system, or combination thereof. Examples of hardware may include analog, digital and mixed circuit s known as microcircuit, microchip, or silicon chip. Examples of the electronic system may include a system on chip (SoC), a system in package (SiP), a computer on module (CoM) and the display apparatus 1. Any of the above-mentioned procedures and examples above may be compiled into program codes or instructions that are stored in a storage device. The storage device may include a computer-readable storage medium. The storage device may include read-only memory (ROM), flash memory, random access memory (RAM), subscriber identity module (SIM), hard disk, floppy diskette, or CD-ROM/DVD-ROM/BD-ROM, but not limited thereto. The processing circuit 302 may read and execute the program codes or the instructions stored in the storage device for realizing the above-mentioned functions. The processing circuit 302 may be a central processing unit (CPU), a microprocessor, a digital signal processor (DSP), a programmable controller, a graphics processing unit (GPU), a programmable logic device (PLD) or other similar devices or combination of these devices, but not limited thereto.

In summary, the conventional display apparatus using the backlight control circuit with constant current dimming usually has the problems of uneven brightness (e.g., obvious grid mura), peripheral dark bands and low contrast. In comparison, the embodiments of the present invention provides the backlight control circuit to generate the adjusted driving currents to drive the surface light-emitting device 20, and thus improving the display uniformity, realizing the brightness compensation of the dark area and the appearance compensation of the overall light-emitting surface, effectively optimizing the brightness distribution of the surface light-emitting device 20 and significantly improving uneven brightness and contrast, and effectively reducing the power consumption.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A backlight control method for a surface light-emitting device, the surface light-emitting device comprising a plurality of first groups and a plurality of second groups, each of the first groups and the second groups comprising at least one backlight zone, backlight zones arranged along a first direction being defined as the first group, backlight zones arranged along a second direction being defined as the second group, and the first direction being not parallel to the second direction, the backlight control method comprising:

generating a plurality of driving currents to drive the surface light-emitting device such that a plurality of backlight zones generates a plurality of brightness values;

measuring the plurality of brightness values of the plurality of backlight zones;

calculating a plurality of uniformities of the plurality of backlight zones according to the plurality of brightness values and setting a plurality of target uniformities;

generating a plurality of adjustment values according to the plurality of uniformities, the plurality of target uniformities and a plurality of adjustment coefficients corresponding to the plurality of backlight zones; and generating a plurality of adjusted driving currents to drive the plurality of backlight zones according to the plurality of adjustment values and the plurality of driving currents.

2. The backlight control method of claim 1, wherein the step of calculating the plurality of uniformities of the plurality of backlight zones according to the plurality of brightness values and setting the plurality of target uniformities comprises:

setting a target brightness value for each backlight zone and calculating a ratio of a brightness value of each backlight zone to a maximum of the plurality of target brightness values of the plurality of backlight zones to obtain a uniformity of each backlight zone.

3. The backlight control method of claim 1, wherein the step of calculating the plurality of uniformities of the plurality of backlight zones according to the plurality of brightness values and setting the plurality of target uniformities comprises:

setting a target brightness value for each backlight zone and calculating a ratio of the target brightness value of each backlight zone to a maximum of the plurality of brightness values of the plurality of backlight zones to obtain a target uniformity of each backlight zone.

4. The backlight control method of claim 1, wherein the step of calculating the plurality of uniformities of the plurality of backlight zones according to the plurality of brightness values and setting the plurality of target uniformities comprises:

obtaining a target uniformity of a central backlight zone located at or near a center of the surface light-emitting device and located at an intersection of one of the plurality of first groups and one of the plurality of second groups, obtaining target uniformities of backlight zones on both side edges along the first direction of a first group comprising the central backlight zone of the plurality of first groups, and calculating the target uniformity of each backlight zone of the first group according to a first equation; and obtaining target uniformities of backlight zones on both side edges along the obtaining target uniformities of backlight zones on both side edges along the second direction of a second group comprising the central backlight zone of the plurality of second groups, and calculating the target uniformity of each backlight zone of the second group according to a second equation and the target uniformities of the central backlight zone and the backlight zones on both side edges along the second direction of the second group;

wherein a curve formed by the first equation has a first curvature, a curve formed by the second equation has a second curvature, and the first curvature is smaller than or equal to the second curvature.

5. The backlight control method of claim 4, wherein a backlight zone located at or near a center of the surface light-emitting device and located at an intersection of one of the plurality of first groups and one of the plurality of second groups is defined as a central backlight zone, a maximum distance between a backlight zone closest to the edge among the plurality of first groups and the central backlight zone is greater than a maximum distance between a backlight zone closest to the edge among the plurality of second groups and the central backlight zone, and the first curvature is smaller than the second curvature.

6. The backlight control method of claim 1, wherein a first adjustment value of the plurality of adjustment values corresponds to backlight zones of a first one of the plurality of first groups, a second adjustment value of the plurality of adjustment values corresponds to backlight zones of a second one of the plurality of first groups, and the first adjustment value is different from the second adjustment value.

7. The backlight control method of claim 6, wherein the step of generating the plurality of adjustment values according to the plurality of uniformities, the plurality of target uniformities and the plurality of adjustment coefficients corresponding to the plurality of backlight zones comprises: for each backlight zone of the first one of the plurality of first groups, calculating a first uniformity ratio by dividing a target uniformity of each backlight zone of the first one of the plurality of first groups by a uniformity of each backlight zone of the first one of the plurality of first groups, and performing an exponentiation operation on the first uniformity ratio with a power of the first adjustment coefficient to generate an adjustment value corresponding to each backlight zone of the first one of the plurality of first groups; and for each backlight zone of the second one of the plurality of first groups, calculating a second uniformity ratio by dividing a target uniformity of each backlight zone of the second one of the plurality of first groups by a uniformity of each backlight zone of the second one of the plurality of first groups, and performing an exponentiation operation on the second uniformity ratio with a power of the second adjustment coefficient to generate an adjustment value corresponding to each backlight zone of the second one of the plurality of first groups.

8. The backlight control method of claim 6, wherein the step of generating the plurality of adjustment values according to the plurality of uniformities, the plurality of target uniformities and the plurality of adjustment coefficients corresponding to the plurality of backlight zones determines the plurality of adjustment values according to the following equation:

$$A_{i,k} = \left(\frac{UT_{i,k}}{U_{i,k}}\right)^{G_k}$$

where $A_{i,k}$ represents an adjustment value of i-th backlight zone of k-th first group; $UT_{i,k}$ represents a target uniformity of i-th backlight zone of k-th first group; $U_{i,k}$ represents a uniformity of i-th backlight zone of k-th first group; $G_k$ represents an adjustment coefficient corresponding to the k-th first group; and i is between 1 and m, k is between 1 and n.

9. The backlight control method of claim 6, wherein a backlight zone located at or near a center of the surface light-emitting device and located at an intersection of one of the plurality of first groups and one of the plurality of second groups is defined as a central backlight zone, a minimum distance between the backlight zones of the first one of the plurality of first groups and the central backlight zone is smaller than a minimum distance between the backlight zones of the second one of the plurality of first groups and the central backlight zone, and the first adjustment value corresponding to the backlight zones of the first one of the plurality of first groups is greater than the second adjustment value corresponding to the backlight zones of the second one of the plurality of first groups.

10. The backlight control method of claim 1, wherein the step of generating the plurality of adjusted driving currents to drive the plurality of backlight zones according to the plurality of adjustment values and the plurality of driving currents comprises: for each backlight zone, generating an adjusted driving current corresponding to each backlight zone, wherein the adjusted driving current corresponding to each backlight zone is a product of an adjustment value corresponding to each backlight zone and a driving current corresponding to each backlight zone.

11. The backlight control method of claim 1, wherein the step of generating the plurality of adjusted driving currents to drive the plurality of backlight zones according to the plurality of adjustment values and the plurality of driving currents comprises:

for each backlight zone, determining whether a uniformity of each backlight zone is greater than a target uniformity of each backlight zone;

when determining that the uniformity of each backlight zone is greater than the target uniformity of each backlight zone, generating a driving current corresponding to each backlight zone to drive each backlight zone; and when determining that the uniformity of each backlight zone is smaller than or equal to the target uniformity of each backlight zone, generating an adjusted driving current corresponding to each backlight zone to drive each backlight zone, wherein the adjusted driving current corresponding to each backlight zone is a product of an adjustment value corresponding to each backlight zone and the driving current corresponding to each backlight zone.

12. The backlight control method of claim 1, wherein the surface light-emitting device comprises a light source module and a backlight module, the light source module comprises a substrate and a plurality of light-emitting diodes disposed on the substrate, the backlight module is arranged above the plurality of light-emitting diodes and the backlight module defines the plurality of backlight zones, the light source module defines a plurality of light-emitting zones, each light-emitting zone comprises at least one light-emitting diode, and the number of the plurality of light-emitting zones is greater than or equal to the number of the plurality of backlight zones.

13. The backlight control method of claim 12, further comprising:

generating a plurality of pre-driving currents to drive the surface light-emitting device such that the plurality of light-emitting zones generates the plurality of brightness values;

measuring the plurality of brightness values of the plurality of light-emitting zones;

calculating an average value of the plurality of brightness values of the plurality of light-emitting zones and calculating a standard deviation of the plurality of brightness values according to the average value of the plurality of brightness values; and when the standard deviation is greater than or equal to a threshold value, generating a plurality of compensation values to combine and convert the plurality of compensation values and the plurality of pre-driving currents into a plurality of compensation driving currents so as to drive the plurality of light-emitting zones, until the standard deviation is less than the threshold value, stopping generating the plurality of compensation values, and determining the plurality of compensation driving currents as the plurality of driving currents generated by the step of generating the plurality of driving currents to drive the surface light-emitting device such that the plurality of backlight zones generates the plurality of brightness values.

14. A backlight control circuit for driving a surface light-emitting device, the surface light-emitting device comprising a plurality of first groups and a plurality of second groups, each of the first groups and the second groups comprising at least one backlight zone, backlight zones arranged along a first direction being defined as the first group, backlight zones arranged along a second direction being defined as the second group, and the first direction being not parallel to the second direction, the backlight control circuit comprising:

a driving circuit configured to generate a plurality of driving currents to drive the surface light-emitting device such that a plurality of backlight zones generates a plurality of brightness values;

a measurement circuit configured to measure the plurality of brightness values of the plurality of backlight zones; and a processing circuit configured to calculate a plurality of uniformities of the plurality of backlight zones according to the plurality of brightness values, set a plurality of target uniformities, and generate a plurality of adjustment values according to the plurality of uniformities, the plurality of target uniformities and a plurality of adjustment coefficients corresponding to the plurality of backlight zones, such that the driving circuit is configured to generate a plurality of adjusted driving currents to drive the plurality of backlight zones according to the plurality of adjustment values and the plurality of driving currents.

15. The backlight control circuit of claim 14, wherein the processing circuit is configured to set a target brightness value for each backlight zone and calculate a ratio of a brightness value of each backlight zone to a maximum of the plurality of target brightness values of the plurality of backlight zones to obtain a uniformity of each backlight zone.

16. The backlight control circuit of claim 14, wherein the processing circuit is configured to set a target brightness value for each backlight zone and calculate a ratio of the target brightness value of each backlight zone to a maximum of the plurality of brightness values of the plurality of backlight zones to obtain a target uniformity of each backlight zone.

17. The backlight control circuit of claim 14, wherein the processing circuit is configured to obtain a target uniformity of a central backlight zone located at or near a center of the surface light-emitting device and located at an intersection of one of the plurality of first groups and one of the plurality of second groups, obtain target uniformities of backlight zones on both side edges along the first direction of a first group comprising the central backlight zone of the plurality of first groups, and calculate the target uniformity of each backlight zone of the first group according to a first equation, and the processing circuit is configured to obtain target uniformities of backlight zones on both side edges along the second direction of a second group comprising the central backlight zone of the plurality of second groups and calculate the target uniformity of each backlight zone of the second group according to a second equation and the target uniformities of the central backlight zone and the backlight zones on both side edges along the second direction of the second group, wherein a curve formed by the first equation has a first curvature, a curve formed by the second equation has a second curvature and the first curvature is smaller than or equal to the second curvature.

18. The backlight control circuit of claim 17, wherein a backlight zone located at or near a center of the surface light-emitting device and located at an intersection of one of the plurality of first groups and one of the plurality of second groups is defined as a central backlight zone, a maximum distance between a backlight zone closest to the edge among the plurality of first groups and the central backlight zone is greater than a maximum distance between a backlight zone closest to the edge among the plurality of second groups and the central backlight zone, and the first curvature is smaller than the second curvature.

19. The backlight control circuit of claim 14, wherein a first adjustment value of the plurality of adjustment values corresponds to backlight zones of a first one of the plurality of first groups, a second adjustment value of the plurality of adjustment values corresponds to backlight zones of a second one of the plurality of first groups, and the first adjustment value is different from the second adjustment value.

20. The backlight control circuit of claim 19, wherein for each backlight zone of the first one of the plurality of first groups, the processing circuit is configured to calculate a first uniformity ratio by dividing a target uniformity of each backlight zone of the first one of the plurality of first groups by a uniformity of each backlight zone of the first one of the plurality of first groups and perform an exponentiation operation on the first uniformity ratio with a power of the first adjustment coefficient to generate an adjustment value corresponding to each backlight zone of the first one of the plurality of first groups, and for each backlight zone of the second one of the plurality of first groups, the processing circuit is configured to calculate a second uniformity ratio by dividing a target uniformity of each backlight zone of the second one of the plurality of first groups by a uniformity of each backlight zone of the second one of the plurality of first groups, and perform an exponentiation operation on the second uniformity ratio with a power of the second adjustment coefficient to generate an adjustment value corresponding to each backlight zone of the second one of the plurality of first groups.

21. The backlight control circuit of claim 19, wherein the processing circuit is configured to generate the plurality of adjustment values according to the plurality of uniformities, the plurality of target uniformities and a plurality of adjustment coefficients corresponding to the plurality of backlight zones, wherein the plurality of adjustment values are calculated by the processing circuit according to the following equation:

$$A_{i,k} = \left(\frac{UT_{i,k}}{U_{i,k}}\right)^{G_k}$$

where $A_{i,k}$ represents an adjustment value of i-th backlight zone of k-th first group; $UT_{i,k}$ represents a target uniformity of i-th backlight zone of k-th first group; $U_{i,k}$ represents a uniformity of i-th backlight zone of k-th first group; $G_k$ represents an adjustment coefficient corresponding to the k-th first group; and i is between 1 and m, k is between 1 and n.

22. The backlight control circuit of claim 19, wherein a backlight zone located at or near a center of the surface light-emitting device and located at an intersection of one of the plurality of first groups and one of the plurality of second groups is defined as a central backlight zone, a minimum distance between the backlight zones of the first one of the plurality of first groups and the central backlight zone is smaller than a minimum distance between the backlight zones of the second one of the plurality of first groups and the central backlight zone, and the first adjustment value corresponding to the backlight zones of the first one of the plurality of first groups is greater than the second adjustment value corresponding to the backlight zones of the second one of the plurality of first groups.

23. The backlight control circuit of claim 14, wherein for each backlight zone, the driving circuit is configured to generate an adjusted driving current corresponding to each backlight zone, wherein the adjusted driving current corresponding to each backlight zone is a product of an adjustment value corresponding to each backlight zone and a driving current corresponding to each backlight zone.

24. The backlight control circuit of claim 14, wherein for each backlight zone, the processing circuit is configured to determine whether a uniformity of each backlight zone is greater than a target uniformity of each backlight zone, when determining that the uniformity of each backlight zone is greater than the target uniformity of each backlight zone, the processing circuit is configured to generate a driving current corresponding to each backlight zone to drive each backlight zone, and when determining that the uniformity of each backlight zone is smaller than or equal to the target uniformity of each backlight zone, the processing circuit is configured to generate an adjusted driving current corresponding to each backlight zone to drive each backlight zone, wherein the adjusted driving current corresponding to each backlight zone is a product of an adjustment value corresponding to each backlight zone and the driving current corresponding to each backlight zone.

25. The backlight control circuit of claim 14, wherein the surface light-emitting device comprises a light source module and a backlight module, the light source module comprises a substrate and a plurality of light-emitting diodes disposed on the substrate, the backlight module is arranged above the plurality of light-emitting diodes and the backlight module defines the plurality of backlight zones, the light source module defines a plurality of light-emitting zones, each light-emitting zone comprises at least one light-emitting diode, and the number of the plurality of light-emitting zones is greater than or equal to the number of the plurality of backlight zones.

26. The backlight control circuit of claim 25, wherein the driving circuit is configured to generate a plurality of pre-driving currents to drive the surface light-emitting device such that the plurality of light-emitting zones generates the plurality of brightness values, the measurement circuit is configured to measure the plurality of brightness values of the plurality of light-emitting zones, the processing circuit is configured to calculate an average value of the plurality of brightness values of the plurality of light-emitting zones and calculate a standard deviation of the plurality of brightness values according to the average value of the plurality of brightness values, and when the standard deviation is greater than or equal to a threshold value, the processing circuit is configured to generate a plurality of compensation values to combine and convert the plurality of compensation values and the plurality of pre-driving currents into a plurality of compensation driving currents, and the driving circuit is configured to generate the plurality of compensation driving currents to drive the plurality of light-emitting zones, until the standard deviation is less than the threshold value, the processing circuit is configured to stop generating the plurality of compensation values and determine the plurality of compensation driving currents for acting as the plurality of driving currents for driving the surface light-emitting device.

* * * * *